US005400496A

United States Patent [19]

Kemmner et al.

[11] Patent Number: 5,400,496

[45] Date of Patent: Mar. 28, 1995

[54] METHOD OF MAKING A PLANAR COLLECTOR

[75] Inventors: Ulrich Kemmner, Stuttgart; Karlheinz Burger, Bühl; Hans-Peter Koch, Stuttgart; Peter Sellnau, Baden-Baden, all of Germany

[73] Assignee: Robert Bosch GmbH, Stuttgart, Germany

[21] Appl. No.: 157,917

[22] Filed: Nov. 24, 1993

Related U.S. Application Data

[63] Continuation of Ser. No. 838,741, Mar. 10, 1992, abandoned.

[30] Foreign Application Priority Data

Jul. 13, 1990 [DE] Germany ..... 9010542 U

[51] Int. Cl.[6] ..... H01R 43/08

[52] U.S. Cl. ..... 29/597; 310/237

[58] Field of Search ..... 29/597; 310/237, 234, 310/235, 42

[56] References Cited

U.S. PATENT DOCUMENTS 5,157,299 10/1992 Gerlach ..... 310/237

5,175,463 12/1992 Farago et al. ..... 29/597 X

FOREIGN PATENT DOCUMENTS 8908077 2/1989 Germany .

*Primary Examiner*—Carl E. Hall

*Attorney, Agent, or Firm*—Michael J. Striker

[57] ABSTRACT

A planar collector for an electric machine having radial commutator laminations arranged at an electrically insulating carrier. A plate (11) which can be soldered or welded and is divided into segments (11') with connections (17) is arranged on the electrically insulating carrier (10) and has a segmentation congruent to the commutator laminations (15), the commutator laminations (15) being soldered or welded on the plate (11).

2 Claims, 1 Drawing Sheet

METHOD OF MAKING A PLANAR COLLECTOR

This is a continuation of application Ser. No. 838,741, filed Mar. 10, 1992, now abandoned.

BACKGROUND OF THE INVENTION

The present invention relates to a planar collector.

More particularly, it relates to a planar collector for an electric machine with radial commutator laminations arranged on an electrically insulating carrier.

A planar collector is known according to DE-OS 34 22 19. This planar collector has a metallic carrier whose surface is provided with an insulating layer, the commutator bars or laminations being glued to the carrier. DE-OS 34 22 719 further describes forming the commutator laminations from a shell containing radial slots which serve to divide the commutator laminations from one another as soon as the solid region of the shell is removed by machining. A disadvantage consists in that the adhesive does not also withstand the enormous thermal action. For this reason the commutator laminations are also provided with an inner and outer collar to ensure that the centrifugal forces are absorbed and the adhesive surface enlarged.

SUMMARY OF THE INVENTION

Accordingly, it is an object of the present invention to provide a planar collector for an electrical machine, which avoids the disadvantages of the prior art.

In keeping with these objects and with others which will become apparent hereinafter, one feature of the present invention resides, briefly stated, in a planar collector having radial commutator laminations arranged at electrically insulating carrier, wherein in accordance with the present invention a plate is subdivided into segments with connections arranged on the electrically insulating carrier and is divided into segments so as to be congruent to the commutator laminations and the commutator laminations are soldered or welded on the plate.

When the planar collector is designed in accordance with the present invention, it has the advantage that the commutator laminations have a stable connection with the insulating carrier. In addition to its fastening function for the commutator laminations, the plate simultaneously serves to guide off heat. Another advantage of the invention consists in that an abrasion-resistent work material which permits sliding, e.g. carbon, can be used for the running surface of the planar collector as a result of the two-part construction of the collector. This work material is securely anchored in the insulating carrier by the plate. Accordingly, it is simultaneously ensured that the planar collector can be used in electric motors for conveying liquids with relatively high electrical conductivity. The running surface of the planar collector is not corroded by the liquid acting as electrolyte so that the operating reliability of the electric motor is fully maintained.

Advantageous further developments and improvements of the planar collector indicated in the main claim are made possible by the steps named in the subclaims. The planar collector can be produced in a particularly inexpensive manner in that the commutator laminations are formed from a commutator disk having a radial slot, the solid region of the commutator disk being removed by machining after being fastened on the plate. This makes it possible for the complete planar collector provided with the collector laminations to be assembled with the rotor shaft and for the coil wires to be welded with the connections subsequently without loosening the commutator laminations. In the known solutions the slots must be sawed into the planar collector subsequently, which is difficult to do without damaging the rotor axle. Another advantage consists in that the perforations acting as heat barriers form an additional anchoring element for the plate in the electrically insulating carrier and in that the connections for the coil wires arranged at the edge of the plate segments make it possible also to connect the second electrode directly with the plate when welding on the coil wires, which also serves to improve the heat conduction.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
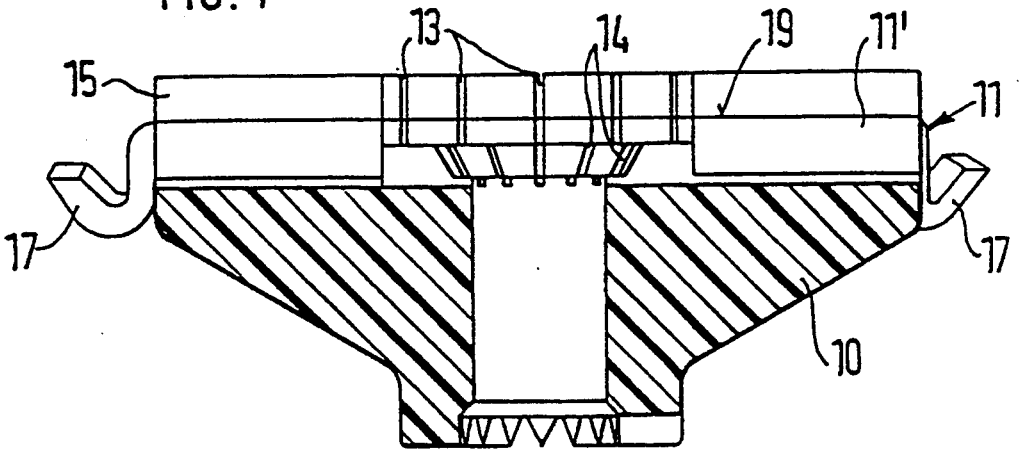
FIG. 1 is a sectional view through a planar collector according to the invention.

The planar collector shown in FIG. 1 has an electrically insulating carrier 10 of plastic in which a plate 11 of copper or nickel is anchored. A commutator disc 12 is arranged on the plate 11 and has commutator laminations 15 fastened to the plate 11. The commutator laminations 15 are electrically insulated from one another by the radial slots 13. The plate 11 likewise has radial slits 14 which are congruent with the radial slots 13 and divide the plate 11 into segments 11' which are electrically insulated from one another. Every segment 11' of the plate 11 has a connection 17 at its circumference for the coil wires of the rotor. The connections 17 are arranged at the edge of every segment 11' according to FIG. 2.

Figure 2:
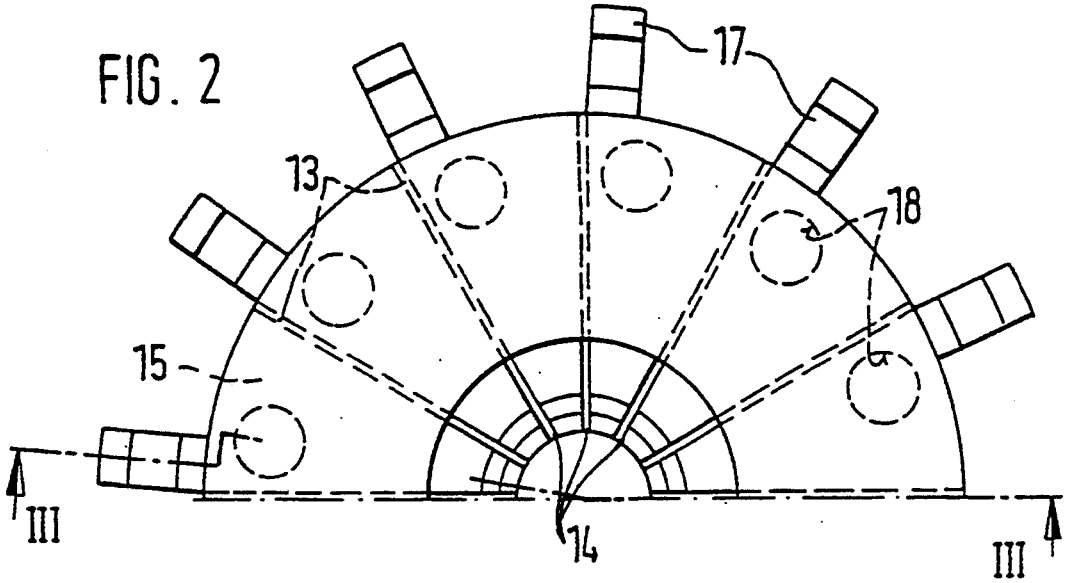
FIG. 2 is a top view of the planar collector prior to the removal of the solid region of a commutator lamination disk by machining.
Figure 3:
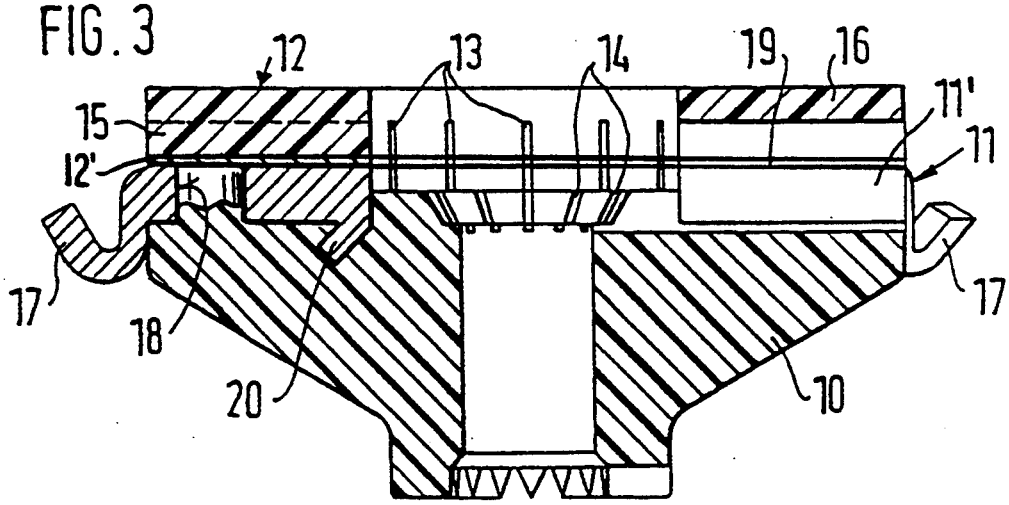
FIG. 3 is a sectional view according to line III—III in FIG. 2.

It can be seen from FIG. 3 that every segment 11' of the plate 11 has one or more hooks 20 which engage in the electrically insulating carrier 10 as anchoring elements. Moreover, every segment 11' of the plate 11 has perforations 18 (FIG. 2 and FIG. 3).

In the present embodiment example the commutator laminations 15 are formed from a commutator disk 12 as can be gathered from FIG. 3. The commutator disk 12 is provided at a front side with radial slots 13 which, as already explained, subsequently form the electrical insulation of the commutator laminations 15 relative to one another.

The planar collector is produced in that the plate 11 is cast in the carrier 10 by the pressure die casting method in such a way that it forms an end face of the carrier 10. Radial slits 14 are then sawed into the plate 11 as in conventional commutator production. The radial slits must be executed in such a way that the plate 11 is divided into segments 11' which are insulated electrically relative to one another. It is important that the plate 11 be segmented so as to be congruent to the commutator laminations 15 of the commutator disk 12.

The commutator disk 12 is made of graphite bonded by plastic and is pressed as such. The end face of the commutator disk 12 provided with radial slots 13 is metallized and then provided with a solder layer 12'. The commutator disk 12 is then placed on the carrier provided with the segmented plate 11 in a soldering device in such a way that the segments 11' of the plate 11 and the laminations 15 are congruent to one another.

The commutator disk 12 is soldered by the application of heat with the segments 11' of the plate by the joint face 19 provided with solder layer 12' so that the planar collector has the form shown as a sectional view in FIG. 3.

The planar collector obtained in this way is then mounted on the rotor, not shown in the drawing. The coil wires of the rotor are welded with the connections 17 of the segments 11' of the plate 11. The rotor is then clamped in a machining tool, e.g. a lathe, and the solid region 16 of the commutator disk 12 is removed by machining until the radial slots 13 are exposed.

Another variant of the planar collector consists in that the insulating carrier 10 is mounted together with the segmented plate 11 on the rotor and the coil wires of the rotor are welded with the connections 17. The commutator disk 12 is then soldered on the plate 11 connected with the rotor, as has already been described. The solid region 16 of the commutator disk 12 is then removed by machining as already described above.

But it is also conceivable to clamp the arrangement of the planar collector shown in FIG. 3 in the machining tool to remove the solid region 16 of the commutator disk 12 by machining. Only then is the finished planar collector obtained in this way mounted on the rotor.

As can be seen from FIG. 2, the connections 17 are arranged at the edge of the segments 11' of the plate 11. The second welding electrode can also be connected directly with the plate 11 during the welding of the coil wires, which serves to improve the heat conduction.

The perforations inserted in the segments 11' of the plate 11 act as heat barriers when welding the coil wires in such a way that they prevent the conduction of heat via the entire segment of the plate 11. Since the perforations 18 fill up with the material of the carrier 10 during the pressure die casting, they bring about an additional anchoring of the segments of the plate 11 in the carrier 10. It is also possible to weld the commutator disc 12 by its joint face 19 on the segmented plate 11, with a weld layer therebetween.

It will be understood that each of the elements described above, or two or more together, may also find a useful application in other types of constructions differing from the types described above.

While the invention has been illustrated and described as embodied in a planar collector and a method of producing the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A method of producing a planar collector for an electrical machine, comprising the steps of providing an electrically insulating carrier with a metal plate subdivided into a plurality of segments; making a commutator disc with a plurality of radial slots on one end face so that on the one end face of the commutator disc a plurality of segments are produced in correspondence with the segments of the metal plate while on another end face of the commutator disc a solid uninterrupted region is retained; forming a metallized layer on the one end face of the commutator disc which has the radial slots; arranging a solder on the metallized layer; applying the commutator disc with the one end face onto the metal plate so that the segments of the metal plate and the segments of the commutator disc coincide with each other; connecting the commutator disc with the metal plate by soldering; and removing the uninterrupted region of the commutator disc so as to form in the commutator disc a plurality of individual commutator laminations.

2. A method as defined in claim 1, wherein said commutator laminations are composed of graphite bonded by plastics and metallized by the metallized layer on the one end face.

* * * * *